US006408833B1

(12) United States Patent
Faletti

(10) Patent No.: US 6,408,833 B1
(45) Date of Patent: Jun. 25, 2002

(54) VENTURI BYPASS EXHAUST GAS RECIRCULATION SYSTEM

(75) Inventor: James J. Faletti, Spring Valley, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/732,470

(22) Filed: Dec. 7, 2000

(51) Int. Cl.[7] ..... F02M 25/07
(52) U.S. Cl. ..... 123/568.17; 60/605.2
(58) Field of Search ..... 123/568.17, 568.18; 60/605.2

(56) References Cited

U.S. PATENT DOCUMENTS

| | | | | | |
|---|---|---|---|---|---|
| 3,662,722 | A | * | 5/1972 | Sarto | 123/568.17 |
| 3,866,586 | A | * | 2/1975 | Scott, Jr. | 123/568.17 |
| 4,005,579 | A | | 2/1977 | Lloyd | |
| 4,026,256 | A | | 5/1977 | Fenn | |
| 4,048,968 | A | | 9/1977 | Aoyama | |
| 4,137,879 | A | * | 2/1979 | Kageyama et al. | 123/568.17 |
| 4,147,143 | A | | 4/1979 | Harada | |
| 4,150,648 | A | | 4/1979 | Ogita | |
| 4,270,508 | A | | 6/1981 | Lindberg | |
| 4,290,403 | A | | 9/1981 | Ziniades | |
| 4,478,199 | A | | 10/1984 | Narasaka et al. | |
| 4,614,184 | A | | 9/1986 | Hansen | |
| 4,630,589 | A | | 12/1986 | Hashiguchi et al. | |
| 4,956,973 | A | * | 9/1990 | Fortnagel et al. | 60/605.2 |
| 5,163,295 | A | | 11/1992 | Bradshaw | |
| 5,322,043 | A | * | 6/1994 | Shriner et al. | 123/568.17 |
| 5,379,744 | A | | 1/1995 | Pischke et al. | |
| 5,611,203 | A | | 3/1997 | Henderson et al. | |
| 6,062,027 | A | * | 5/2000 | Landfahrer et al. | 60/605.2 |
| 6,205,785 | B1 | * | 3/2001 | Coleman | 60/605.2 |
| 6,324,847 | B1 | * | 12/2001 | Pierpont | 60/605.2 |

* cited by examiner

*Primary Examiner*—Paul J. Hirsch
(74) *Attorney, Agent, or Firm*—Taylor & Aust. P.C.

(57) ABSTRACT

An internal combustion engine is provided with a combustion air supply, an intake manifold, an exhaust manifold, and an exhaust gas recirculation system having a venturi assembly. The venturi assembly includes an outlet, a combustion air inlet connected and in communication with the combustion air supply, and an exhaust gas inlet connected and in communication with the exhaust manifold. A bypass fluid line and a bypass valve in the nature of a check valve are provided to bypass the venturi assembly. The check valve is responsive to changes in pressure drop across the venturi assembly, to open and close the bypass fluid line and limit the pressure drop across the venturi assembly.

20 Claims, 1 Drawing Sheet

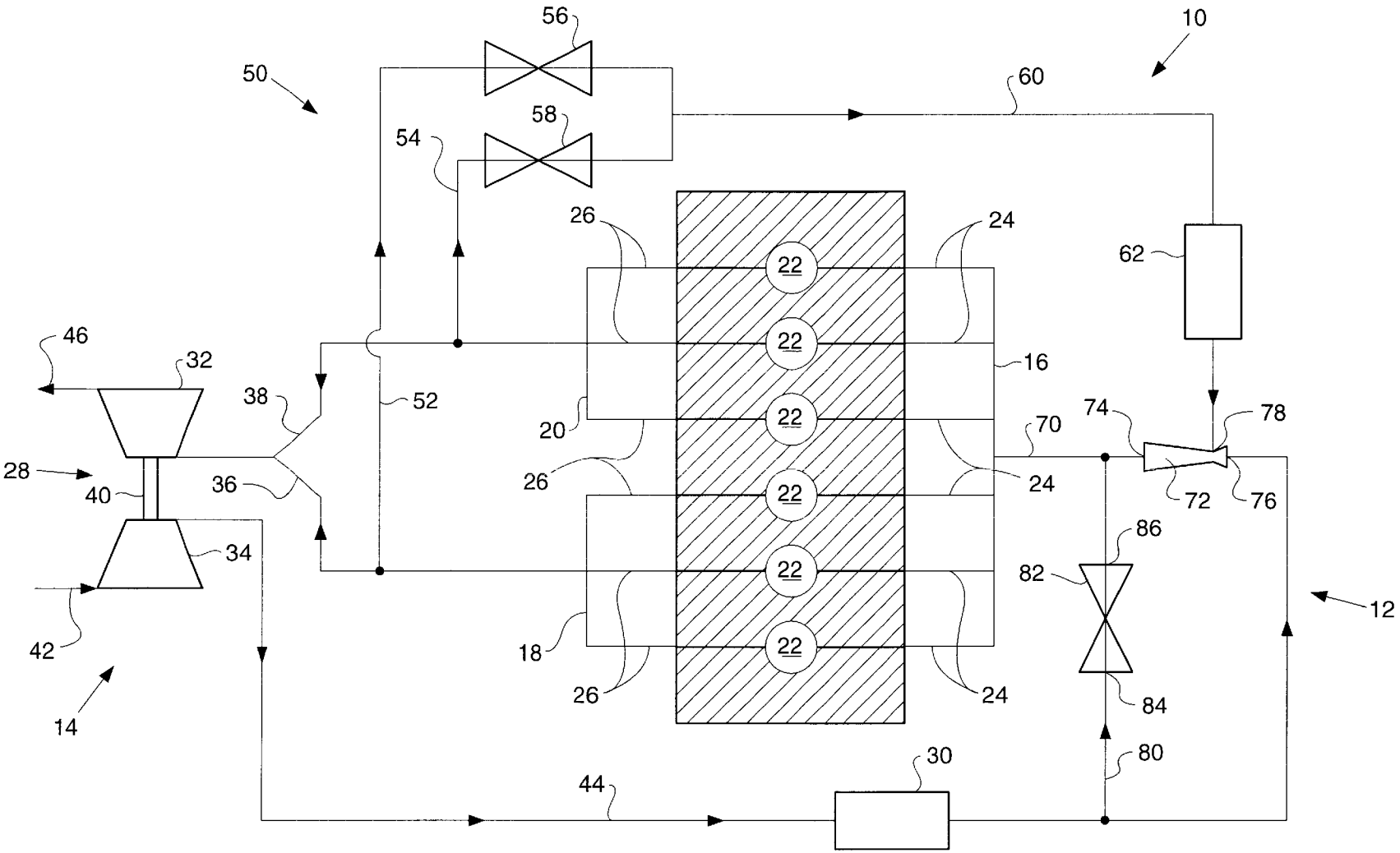
10
12
14
16
18
20
22
24
26
28
30
32
34
36
38
40
42
44
46
50
52
54
56
58
60
62
70
72
74
76
78
80
82
84
86

VENTURI BYPASS EXHAUST GAS RECIRCULATION SYSTEM

TECHNICAL FIELD

The present invention relates to exhaust gas recirculation systems in an internal combustion engine, and, more particularly, to a bypass system for an induction venturi assembly in such exhaust gas recirculation systems.

BACKGROUND ART

An exhaust gas recirculation (EGR) system is used for controlling the generation of undesirable pollutant gases and particulate matter in the operation of internal combustion engines. Such systems have proven particularly useful in internal combustion engines used in motor vehicles such as passenger cars, light duty trucks, and other on-road motor equipment. EGR systems primarily recirculate the exhaust gas by-products into the intake air supply of the internal combustion engine. The exhaust gas which is reintroduced to the engine cylinder reduces the concentration of oxygen therein, which in turn lowers the maximum combustion temperature within the cylinder, and slows the chemical reaction of the combustion process, decreasing the formation of nitrous oxides (NOx). Furthermore, the exhaust gases typically contain unburned hydrocarbons, which are burned upon reintroduction into the engine cylinder, further reducing the emission of exhaust gas by-products that otherwise would be emitted as undesirable pollutants from the internal combustion engine.

When utilizing EGR in a turbocharged diesel engine, the exhaust gas to be recirculated is preferably removed upstream of the exhaust gas driven turbine associated with the turbocharger. In many EGR applications, the exhaust gas is diverted directly from the exhaust manifold. Likewise, the recirculated exhaust gas is preferably reintroduced to the intake air stream downstream of the compressor and air-to-air aftercooler (ATAAC). Reintroducing the exhaust gas downstream of the compressor and ATAAC is preferred due to reliability and maintainability concerns that arise if the exhaust gas passes through the compressor and/or ATAAC. An example of such an EGR system is disclosed in U.S. Pat. No. 5,802,846 (Bailey), which is assigned to the assignee of the present invention.

With conventional EGR systems as described above, the charged and cooled combustion air transported from the ATAAC is at a relatively high pressure, as a result of the charging from the turbocharger. Since, typically, the exhaust gas is inducted into the combustion air flow downstream of the ATAAC, conventional EGR systems are configured to allow the lower pressure exhaust gas to mix with the higher pressure combustion air before the combined flow is introduced in to the intake manifold. Such EGR systems may include a venturi assembly, which induces the flow of exhaust gas into the flow of combustion air passing therethrough. An efficient venturi assembly is designed to "pump" exhaust gas from a lower pressure exhaust manifold to a higher pressure intake manifold. However, because varying EGR rates are required throughout the engine speed and load range, a variable orifice venturi assembly may be preferred. Such a variable orifice venturi assembly is physically difficult and complex to design and manufacture.

Accordingly, venturi systems including a fixed orifice venturi assembly and a combustion air bypass circuit are favored. The bypass circuit consists of piping and a butterfly valve in a combustion air flow path. The butterfly valve is controllably actuated using an electronic controller which senses various parameters associated with operation of the engine. A bypass circuit can prevent excessive pressure losses in the combustion air circuit, which otherwise might occur during periods of high combustion air flow rates, such as at high engine speeds.

With a venturi assembly as described above, the maximum flow velocity and minimum pressure of the combustion air flowing through the venturi assembly occurs within the venturi throat disposed upstream from the expansion section. The butterfly valve is used to control the flow of combustion air to the venturi throat, which in turn affects the flow velocity and vacuum pressure created therein. By varying the vacuum pressure, the amount of exhaust gas induced into the venturi throat of the venturi assembly can be varied. However, the butterfly valve and electronic controller therefor can add complexity to the EGR system, increasing the chance for system failure and increasing the expense associated with repair.

The present invention is directed to overcoming one or more of the problems as set forth above.

DISCLOSURE OF THE INVENTION

In one aspect of the invention, an internal combustion engine comprises a combustion air supply, an exhaust manifold and an intake manifold. A venturi assembly includes an outlet connected and in communication with the intake manifold, a combustion air inlet connected and in communication with the combustion air supply, and an exhaust gas inlet connected and in communication with the exhaust manifold. A bypass fluid line is connected and in communication with the combustion air supply, and connected and in communication with the intake manifold, bypassing the venturi assembly. A bypass valve, controls flow through the bypass fluid line, the bypass valve being responsive to pressure differential on opposite sides of the venturi assembly.

In another aspect of the present invention, a venturi bypass system for recirculating exhaust gas in an internal combustion engine, comprises a venturi assembly having an outlet, a combustion air inlet and an exhaust gas inlet; a bypass line conducting combustion air around the venturi assembly; and a bypass valve positioned in the bypass line to open and close the bypass line in response to pressure drop across the venturi assembly.

In still another aspect of the present invention, a method of recirculating exhaust gas in an internal combustion engine, comprises providing an exhaust gas recirculation system including a venturi assembly having a combustion air inlet, an exhaust gas inlet and an outlet; transporting combustion air to the combustion air inlet; transporting exhaust gas to the exhaust gas inlet; and selectively controlling flow through the bypass line in response to pressure drop across the venturi assembly, thereby controlling the pressure drop across the venturi assembly.

BRIEF DESCRIPTION OF THE DRAWINGS

The sole drawing, FIG. 1, illustrates an internal combustion engine including an embodiment of a venturi bypass exhaust gas re-circulation system of the present invention.

BEST MODE FOR CARRYING OUT THE INVENTION

Referring now to the drawing, there is shown an embodiment of an internal combustion engine 10, including an embodiment of a venturi bypass system 12 of the present invention. Internal combustion engine 10 also includes a combustion air supply 14, intake manifold 16, exhaust manifolds 18 and 20 and a plurality of combustion cylinders 22. In the embodiment shown, engine 10 includes six combustion cylinders 22, but may include more or fewer combustion cylinders 22, as those skilled in the art will recognize readily.

Intake manifold 16 and exhaust manifolds 18, 20 are each fluidly coupled with a plurality of combustion cylinders 22, as indicated schematically by intake and exhaust fluid lines 24 and 26, respectively. In the embodiment shown, a single intake manifold 16 is fluidly coupled with each combustion cylinder 22. However, it is also possible to configure intake manifold 16 as a split or multiple-piece manifold, each associated with a different group of combustion cylinders. Each exhaust manifold 18 and exhaust manifold 20 is coupled to a plurality of combustion cylinders 22, and, as shown, each is connected to three different combustion cylinders 22. However, it is also possible to configure engine 10 with a single exhaust manifold, or with more exhaust manifolds and with more or fewer combustion cylinders.

Combustion air supply 14 provides a source of pressurized combustion air to venturi bypass system 12, and ultimately to intake manifold 16. Combustion air supply 14 includes a turbocharger 28 and an ATAAC 30, each of which is shown schematically for simplicity. Turbocharger 28 includes a turbine 32 and a compressor 34 therein. The turbine, in known manner, is driven by exhaust gas received from exhaust manifolds 18 and 20 via fluid lines 36 and 38, respectively. Turbine 32 is mechanically coupled with compressor 34, such as by a shaft 40, to drive compressor 34. Compressor 34 receives ambient combustion air, as indicated by arrow 42. Compressor 34 compresses the ambient combustion air, and outputs compressed combustion air via fluid line 44. The compressed combustion air is at an elevated temperature as a result of the work performed thereon during the compression process within turbocharger 28. The hot combustion air is then cooled within ATAAC 30. Spent exhaust gas from turbine 32 is passed from turbocharger 28, as indicated by arrow 46, to subsequent exhaust gas processing, which may include a muffler, not shown, an is ultimately discharged to the ambient environment.

An exhaust gas re-circulation (EGR) system 50 includes fluid lines 52 and 54 from, respectively, exhaust manifolds 18 and 20. EGR valves 56 and 58 are provided in fluid lines 52 and 54, respectively, to control the flow of exhaust gases from exhaust manifolds 18 and 20. Flows from EGR valves 56 and 58 are combined in a single EGR fluid line 60 having an EGR cooler 62 therein.

Venturi bypass system 12 receives cooled and compressed combustion air via line 44, and also receives exhaust gas via EGR fluid line 60. Venturi bypass system 12 controllably mixes a selected amount of exhaust gas with the cooled and compressed combustion air, and outputs the air/exhaust gas mixture to a combustion fluid line 70 fluidly connected to intake manifold 16. More particularly, venturi bypass system 12 includes a venturi assembly 72 having an outlet 74, a combustion air inlet 76 and an exhaust gas inlet 78. Combustion air inlet 76 is connected to, and in communication with, combustion air supply 14, via fluid line 44. Exhaust gas inlet 78 is connected to, and in communication with, exhaust manifolds 18 and 20 via EGR fluid line 60. Outlet 74 is connected to, and in communication with, intake manifold 16 via combustion fluid line 70.

Venturi assembly 72, in known manner, not shown in detail herein, includes a venturi nozzle in communication with combustion air inlet 76. The venturi nozzle defines and terminates at a venturi throat. Venturi assembly 72 further defines an exhaust gas venturi section, which tapers to and terminates at an induction area at which exhaust gas from exhaust gas inlet 78 is inducted into the passing flow of compressed combustion air traveling at an increased velocity and decreased pressure through the induction area. Dependent upon the pressure and velocity of the compressed combustion air, the amount of exhaust gas inducted into the flow may be controllably varied. Venturi assembly 72 also may define a receiver section positioned immediately downstream from the induction area. The receiver section typically has a cross sectional area that remains substantially constant for a predetermined distance in the direction of fluid flow, to assist in uniformly mixing the inducted exhaust gas into the flow of combustion air.

In accordance with the present invention, a bypass fluid line 80 extends between fluid line 44 and combustion fluid line 70, and defines a bypass path for combustion air around venturi assembly 72. A valve 82 is positioned within bypass fluid line 80, and controls the flow of fluid bypassing venturi assembly 72 from fluid line 44 to combustion fluid line 70. Valve 82 is controllably actuated to open and close bypass fluid line 80 in response to pressure drop across venturi assembly 72. In accordance with the present invention, bypass valve 82 is in the form of a check valve that is spring loaded and responsive to the pressure drop across venturi assembly 72. Bypass valve 82 has an inlet 84 on the turbocharger side of valve 82, inlet 82 being in communication with fluid line 44 through bypass line 80. By pass valve 82 has an outlet 86 on the intake manifold side of valve 82, outlet 86 being in communication with combustion fluid line 70 through bypass fluid line 80. Bypass valve 82 is responsive to the pressure differential from inlet 84 to outlet 86, to selectively open after a preset differential is reached. Valve 82 thereby is controllably actuated in response to the pressure drop to selectively open and close, to control an amount of combustion air that flows through bypass fluid line 80, thereby bypassing venturi assembly 72.

INDUSTRIAL APPLICABILITY

During use, combustion occurs within combustion cylinders 22, which produces exhaust gas received within exhaust manifolds 18 and 20. Exhaust gas is transported to turbocharger 28 via fluid lines 36 and 38, for rotatably driving turbine 32 of turbocharger 28. Turbine 32 rotatably drives shaft 40, and thereby compressor 34, which in turn compresses combustion air and outputs compressed combustion air via fluid line 44. The hot, compressed combustion air is cooled within ATAAC 30, and is transported via line 44 to combustion air inlet 76 of venturi assembly 72. The fluid pressure in fluid line 44 is also experienced in bypass line 80, on the turbocharger side of bypass valve 82.

As the combustion air flows through venturi assembly 72, the velocity thereof increases and the pressure decreases. Exhaust gas from exhaust manifolds 18 and 20, cooled in EGR cooler 62 is received at exhaust gas inlet 78 via fluid line 60. Dependent upon the pressure and velocity of the combustion air which flows through venturi assembly 72, the amount of exhaust gas inducted into the passing flow of combustion air is varied. The combustion air/exhaust gas mixture flows from venturi assembly 72, through combustion fluid line 70, to intake manifold 16. The fluid pressure in combustion fluid line 70 is also experienced in bypass line 80, on the intake manifold side of bypass valve 82. By varying the degree to which bypass valve 82 is opened, the amount of compressed air from turbocharger 28 which is allowed to bypass venturi assembly 72 and flow directly to intake manifold 16, may likewise be varied. Bypass valve 82 is provided with a preset spring load to allow a given amount of pressure drop across venturi assembly 72. As the pressure drop across venturi assembly 72 exceeds the pre-established acceptable limit, spring loaded check bypass valve 72 begins to open, allowing bypass flow from fluid line 44 to combustion fluid line 70, through bypass fluid line 80. Combustion air flow from fluid line 44 to combustion fluid line 70, via bypass fluid line 80, limits the pressure drop across venturi assembly 72 to the pre-established acceptable limit for efficient operation of EGR system 50 and venturi assembly 72 thereof.

By way of example, and not limitation, a typical fixed venturi EGR system, at low engine speed may experience a pressure drop across venturi assembly 72 of 8 kPa, which allows adequate EGR induction. At higher engine speeds, the pressure drop across venturi assembly 72 may increase to 28 kPa. Control of the EGR flow to desired levels may require the adjustment of EGR valves 56 and 58. However, with a venturi bypass system 12 of the present invention, bypass check valve 82 may be set to limit pressure drop across venturi assembly 72 to, for example, 15 kPa. If the pressure drop exceeds 15 kPa, valve 82 opens sufficiently to allow flow through bypass fluid line 80, and limit the pressure drop to 15 kPa.

Venturi bypass system 12 of the present invention allows exhaust gas to be effectively and controllably inducted into a pressurized flow of combustion air, over a wide range of engine operating speeds and conditions, using a fixed venturi assembly. The simplicity of the system minimizes the risk of failure and the expense of repair. Thus, the venturi bypass system provides a compact design with simple and efficient operation.

Other aspects, objects and advantages of this invention can be obtained from a study of the drawings, the disclosure and the appended claims.

What is claimed is:

1. An internal combustion engine, comprising:

a combustion air supply;

an exhaust manifold;

an intake manifold;

a venturi assembly including an outlet connected and in communication with said intake manifold, a combustion air inlet connected and in communication with said combustion air supply, and an exhaust gas inlet connected and in communication with said exhaust manifold;

a bypass fluid line connected and in communication with,said combustion air supply, and connected and in communication with said intake manifold and bypassing said venturi assembly; and a bypass valve, controlling flow through said bypass fluid line, said bypass control valve being responsive to pressure differential on opposite sides of said venturi assembly.

2. The internal combustion engine of claim 1, said bypass valve being a spring loaded check valve.

3. The internal combustion engine of claim 2, said spring loaded check valve arranged to open in response to increased pressure drop across said venturi assembly.

4. The internal combustion engine of claim 3, said combustion air supply including an exhaust gas turbocharger.

5. The internal combustion engine of claim 1, said combustion air supply including an exhaust gas turbocharger.

6. The internal combustion engine of claim 1, said combustion air supply including a turbocharger having a turbine in communication with and operated by exhaust gas flow from said exhaust manifold and a compressor operated by said turbine, said compressor providing combustion air to said intake manifold.

7. The internal combustion engine of claim 6, including a fluid line from said compressor to said venturi assembly, and said bypass fluid line connected to and in communication with said fluid line from said compressor.

8. The internal combustion engine of claim 7, including a combustion fluid line from said venturi assembly to said intake manifold, and said bypass fluid line connected to and in communication with said combustion fluid line.

9. The internal combustion engine of claim 8, including an aftercooler in said fluid line from said compressor.

10. The internal combustion engine of claim 1, including a combustion fluid line from said venturi assembly to said intake manifold, and said bypass fluid line connected to and in communication with said combustion fluid line.

11. A venturi bypass system for recirculating exhaust gas in an internal combustion engine, comprising:

a venturi assembly having an outlet, a combustion air inlet and an exhaust gas inlet;

a bypass fluid line conducting combustion air around said venturi assembly; and a bypass valve positioned in said bypass fluid line to open and close said bypass fluid line in response to pressure drop across said venturi assembly.

12. The venturi bypass system of claim 11, said bypass valve being a spring loaded check valve.

13. The venturi bypass system of claim 11, including a combustion air supply, a fluid line connected to and in flow communication with said combustion air inlet and said combustion air supply, a combustion fluid line connected to and in communication with said outlet, and said bypass fluid line connected to and in flow communication with said fluid line and said combustion fluid line.

14. The venturi bypass system of claim 13, said bypass valve being a spring loaded check valve.

15. The venturi bypass system of claim 14, said check valve being responsive to differential pressure on opposite sides thereof.

16. A method of recirculating exhaust gas in an internal combustion engine, comprising the steps of:

providing an exhaust gas recirculation system including a venturi assembly having a combustion air inlet, an exhaust gas inlet and an outlet;

transporting combustion air to said combustion air inlet;

transporting exhaust gas to said exhaust gas inlet;

providing a bypass fluid line for transporting combustion air around said venturi assembly; and selectively controlling flow through said bypass fluid line in response to pressure drop across said venturi assembly, and thereby controlling a pressure drop across said venturi assembly.

17. The method of claim 16, including selectively operating a bypass valve in response to pressure drop across said venturi assembly.

18. The method of claim 17, including operating said bypass valve to open and close said bypass fluid line in response to the differential pressure on opposite sides of said bypass valve.

19. The method of claim 17, including providing a spring operated check valve in said bypass fluid line, and operating said check valve to open and close said bypass fluid line in response to the differential pressure on opposite sides of said check valve.

20. The method of claim 16, including providing a spring loaded check valve in said bypass fluid line, and operating said spring loaded check valve in response to pressure drop across said venturi assembly.

* * * * *